US010932045B2

(12) United States Patent
Wu et al.

(10) Patent No.: US 10,932,045 B2
(45) Date of Patent: Feb. 23, 2021

(54) SPEAKER

(71) Applicant: AAC Technologies Pte. Ltd., Singapore (SG)

(72) Inventors: Shuwen Wu, Shenzhen (CN); Wei Song, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/535,074

(22) Filed: Aug. 8, 2019

(65) Prior Publication Data

US 2020/0077198 A1 Mar. 5, 2020

(30) Foreign Application Priority Data

Aug. 29, 2018 (CN) ..... 201821411583.7

(51) Int. Cl.

| | |
|---|---|
| ***H04R 7/20*** | (2006.01) |
| ***H04R 1/02*** | (2006.01) |
| ***H04R 9/06*** | (2006.01) |
| ***H04R 9/02*** | (2006.01) |

(52) U.S. Cl.

CPC ..... *H04R 7/20* (2013.01); *H04R 1/021* (2013.01); *H04R 9/025* (2013.01); *H04R 9/06* (2013.01); *H04R 2400/11* (2013.01); *H04R 2499/11* (2013.01)

(58) Field of Classification Search

CPC . H04R 7/20; H04R 9/06; H04R 1/021; H04R 9/025; H04R 2499/11; H04R 2400/11; H04R 9/022

See application file for complete search history.

(56) References Cited

U.S. PATENT DOCUMENTS

| | | | | |
|---|---|---|---|---|
| 7,418,107 B2 * | 8/2008 | Milot | ..... | H04R 7/20 381/398 |
| 8,934,657 B2 * | 1/2015 | Wilk | ..... | H04R 9/043 381/404 |
| 2007/0081693 A1 * | 4/2007 | Andersen | ..... | H04R 7/20 381/423 |

* cited by examiner

*Primary Examiner* — Brian Ensey
(74) *Attorney, Agent, or Firm* — W&G Law Group LLP

(57) ABSTRACT

The present disclosure provides a speaker. The speaker comprises a fixing system and a vibration system, the vibration system includes a membrane, a voice coil for driving the membrane to generate sound, and an elastic part fixedly connected to one end of the voice coil distal from the membrane. The elastic part comprises a diaphragm elastically supporting the voice coil. The diaphragm comprises a first fixing portion fixedly connected to the fixing system, a second fixing portion fixedly connected to the voice coil and an edge connecting the first fixing portion and the second fixing portion. The edge is provided with a plurality of openings. The present disclosure also provides a speaker using a breathable material.

7 Claims, 5 Drawing Sheets

A-A

SPEAKER

FIELD OF THE DISCLOSURE

The present disclosure relates to electro-acoustic transducers, and more particularly to a speaker applied in a portable electronic device.

DESCRIPTION OF RELATED ART

With the miniaturization and multi-functional development of various audio equipments and information communication equipments, the speaker used in the aforesaid equipments tend to be more miniaturized and more compact with the other components around the speakers. In particular, with the development demand of mobile phone thinning, the speaker used therein requires not only miniaturization but also high-quality sound and stereo sound.

The speaker acts as a sound player, the speaker's structural design directly affects the sound quality.

A speaker in the related art includes a frame, a membrane, a voice coil that is located beneath the membrane for driving the membrane to vibrate and generate sound, a diaphragm for elastically supporting the voice coil, and a support part, wherein the membrane includes a folding ring part and a dome.

In the related art, air and heat in an area between the membrane and the diaphragm in the related speaker structure may be discharged through the gap between the folding ring part and the frame, resulting in the flow of air and heat inside of the speaker is not smooth and the reduction of the heat dissipation performance of the speaker.

Therefore, it is desired to provide a speaker to overcome the aforesaid problems.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the present disclosure.

The present disclosure is further described in combination with the drawings and specific embodiments.

Embodiment 1

Figure 1:
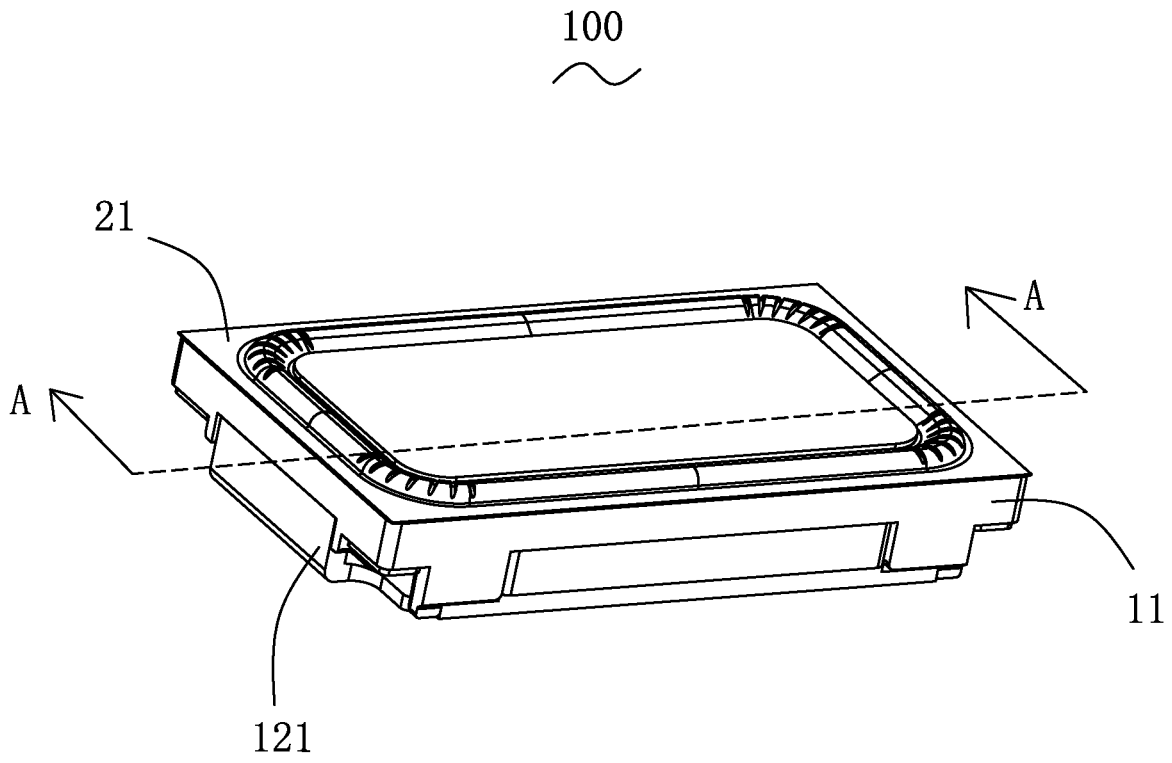
FIG. 1 is an isometric view of a speaker according to the present disclosure.
Figure 2:
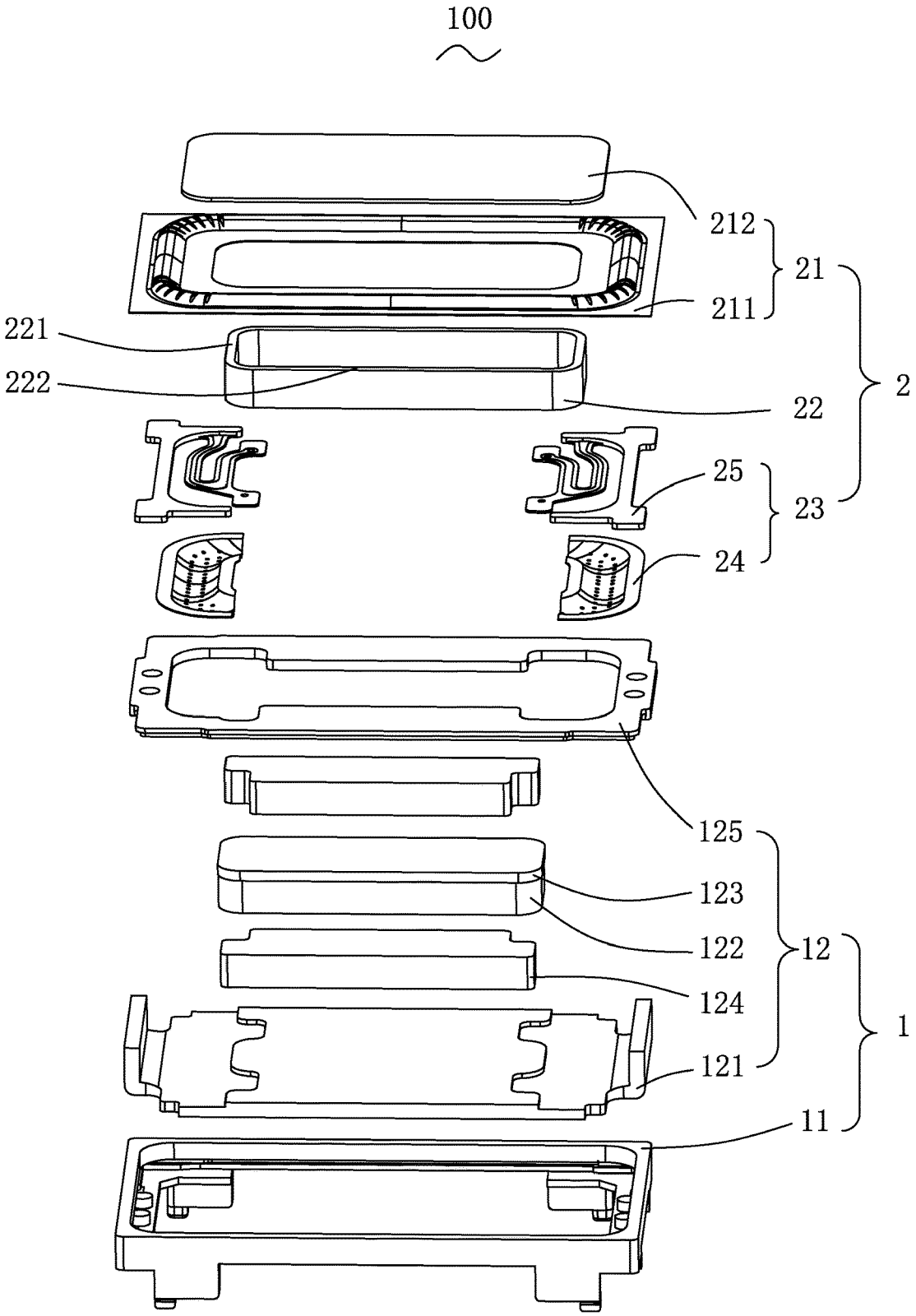
FIG. 2 is an exploded view of the speaker as illustrated in FIG. 1.
Figure 3:
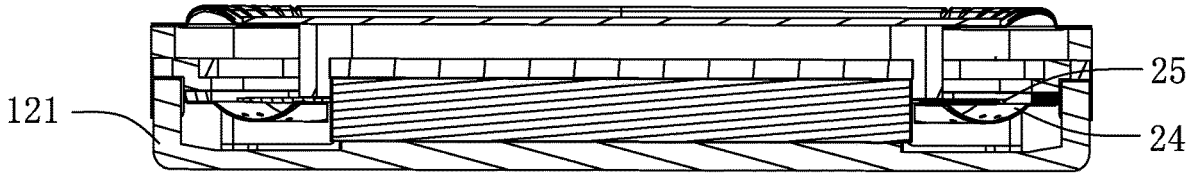
FIG. 3 is a perspective view taken along line A-A in the isometric view as illustrated in FIG. 1.
Figure 4:
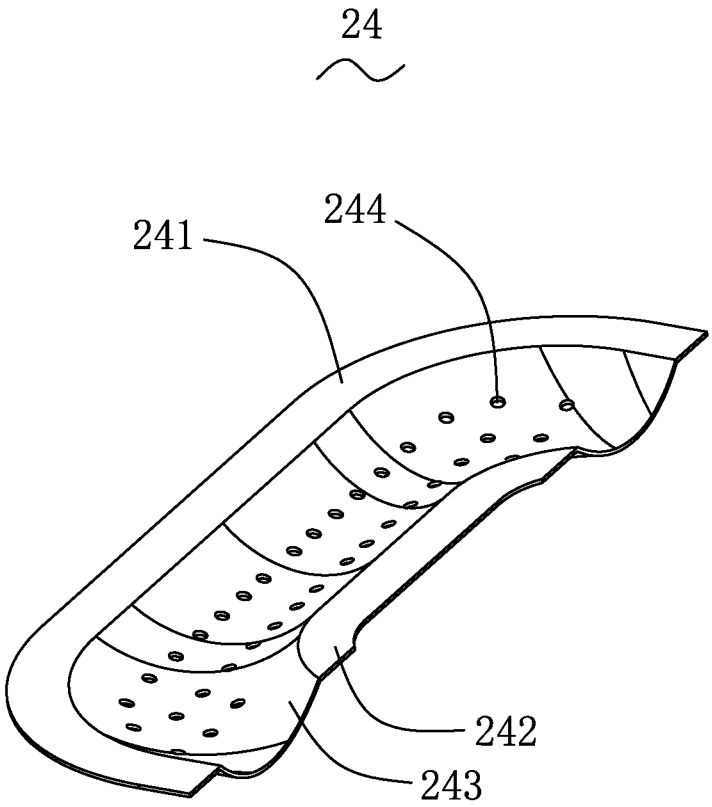
FIG. 4 is an isometric diagram of a diaphragm of a first embodiment of the present disclosure.

Referring to FIG. 1 to FIG. 4, FIG. 1 is an isometric view of a speaker according to the present disclosure, FIG. 2 is an exploded view of the speaker as illustrated in FIG. 1, FIG. 3 is a perspective view taken along line A-A in the isometric view as illustrated in FIG. 1, and FIG. 4 is an isometric diaphragm of a first embodiment of the present disclosure. The present disclosure provides a speaker 100. The speaker includes a fixing system 1 and a vibration system 2.

The vibration system 2 includes a membrane 21, a voice coil 22 for driving the membrane 21 to vibrate and generate sound, and an elastic part 23 fixedly connected to one end of the voice coil 22 distal from the membrane 21.

The membrane 21 includes a folding ring part 211 and a dome 212 overlaid on the folding ring part 211.

The elastic part 23 includes a diaphragm 24 configured to elastically support the voice coil 22. The diaphragm 24 includes a first fixing portion 241 fixedly connected to the fixing system 1, a second fixing portion 242 fixedly connected to the voice coil 22 and an edge 243 connecting the first fixing portion 241 and the second fixing portion 242. The edge 243 is recessed in a direction distal from the membrane 21.

The fixing system 1 includes a frame 11 and a magnetic circuit system 12 accommodated in the frame 11. The magnetic circuit system 12 includes a yoke 121, a primary magnet 122 disposed on the yoke 121, a primary pole plate 123 disposed on the primary magnet 122, a secondary magnet 124 surrounding the primary magnet 122 and forming a magnetic gap with the primary magnet 122, and a secondary pole plate 125 disposed on the secondary magnet 124.

The elastic part 23 further comprises a supporting part 25 fixedly connected to the fixing system 1 and elastically supporting the voice coil 22. The supporting member 25 is superposed on one side of the diaphragm 24 adjacent to the membrane 21. The first fixing portion 241 is fixedly connected to the fixing system 1 through the supporting part 25. The second fixing portion 242 is fixedly connected to the voice coil 22 through the supporting part 25.

The voice coil 22 includes a pair of short-axis edges 221 and a pair of long-axis edges 222 connecting to the short-axis edges 221. The number of the elastic part 23 is one pair, and each of the elastic part 23 is respectively disposed on one side of the short-axis edge 221.

The edge 243 is provided with a plurality of openings 244, and the openings 244 are evenly spaced apart from the edge 243. The opening 244 is a circular shape.

It should be noted that, the opening 244 of the embodiment is evenly spaced apart from the edge 243, which is a preferred embodiment of the present disclosure. In other embodiments, the opening 244 of the edge 243 also may be arranged in other intervals.

What's more, the opening 244 having a circular shape of the embodiment is a preferred embodiment of the present disclosure. In other optional embodiments, the openings 244 may have other shapes.

Embodiment 2

Figure 5:
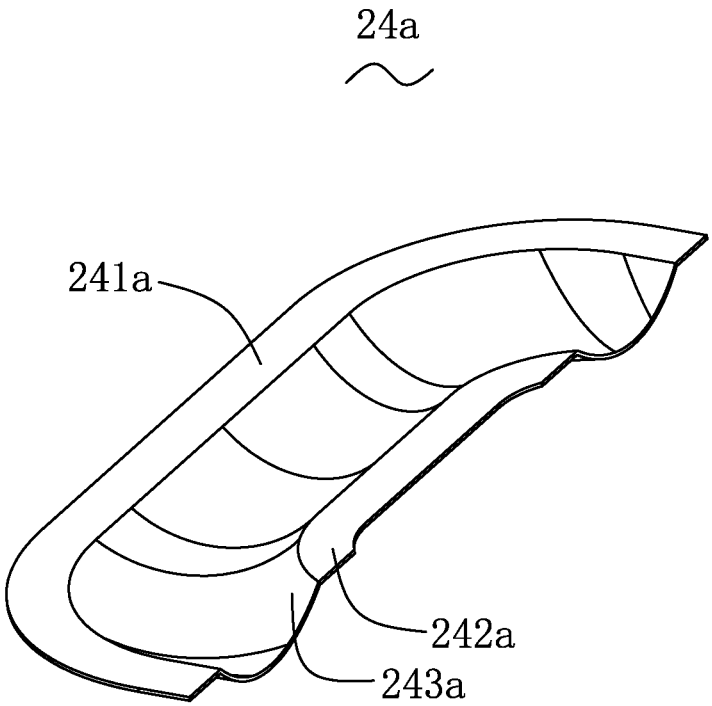
FIG. 5 is an isometric diagram of a diaphragm of a second embodiment of the present disclosure.

The structure of the speaker 100 provided in the present embodiment is the same as that provided in the first embodiment. As shown in FIG. 5, the difference is that the diaphragm 24*a* is a breathable diaphragm, that is, the diaphragm 24*a* is made of breathable material, and the diaphragm 24*a* includes a first fixing portion 241*a* fixedly connected to the speaker 100, a second fixing portion 242*a* fixedly connected to the speaker 100, and an edge 243*a* connected to the first fixing portion 241*a* and the second fixing portion 242*a*.

Compared with the related art, the beneficial effect of the present disclosure is that the air and heat between the membrane and the diaphragm of the speaker can flow through the opening or the breathable diaphragm, so that the air and heat flow inside the speaker of the present disclosure is smooth, and the heat dissipation performance of the speaker is improved.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A speaker, comprising:

a fixing system; and a vibration system which comprising:

a membrane;

a voice coil configured to drive the membrane to generate sound; and an elastic part fixedly connected to one end of the voice coil away from the membrane, which comprises a diaphragm for elastically supporting the voice coil, and the diaphragm comprises a first fixing portion fixedly connected to the fixing system, a second fixing portion fixedly connected to the voice coil, and an edge connecting the first fixing portion and the second fixing portion, wherein the edge is provided with a plurality of openings;

wherein the voice coil comprises a pair of short-axis edges and a pair of long-axis edges connecting the short-axis edges, the number of the elastic part is one pair, and each of the elastic part is respectively disposed on one side of the short-axis edges.

2. The speaker according to claim 1, wherein the openings are evenly spaced on the edge.

3. The speaker according to claim 1, wherein the shape of the opening is circular.

4. The speaker according to claim 1, wherein the edge is recessed in a direction away from the membrane.

5. The speaker according to claim 1, wherein the elastic part further comprises a supporting part fixedly connected to the fixing system and elastically supporting the voice coil, the supporting part is superposed on the diaphragm adjacent to the membrane, the first fixing portion is fixedly connected to the fixing system through the supporting part, the second fixing portion is fixedly connected to the voice coil through the supporting part.

6. The speaker according to claim 1, wherein the fixing system comprises a frame and a magnetic circuit system accommodated in the frame, the magnetic circuit system comprises a yoke, a primary magnet disposed on the yoke, a secondary magnet surrounding the primary magnet and forming a magnetic gap with the primary magnet.

7. A speaker, comprising:

a fixing system; and a vibration system, which comprising:

a membrane;

a voice coil configured to drive the membrane to generate sound; and an elastic part fixedly connected to one end of the voice coil away from the membrane, which comprises a diaphragm for elastically supporting the voice coil, and the diaphragm comprises a first fixing portion fixedly connected to the fixing system, a second fixing portion fixedly connected to the voice coil, and an edge connecting the first fixing portion and the second fixing portion, wherein the diaphragm is a breathable diaphragm;

wherein the voice coil comprises a pair of short-axis edges and a pair of long-axis edges connecting the short-axis edges, the number of the elastic part is one pair, and each of the elastic part is respectively disposed on one side of the short-axis edges.

* * * * *